US007054156B2

(12) United States Patent
Espinoza-Ibarra et al.

(10) Patent No.: US 7,054,156 B2
(45) Date of Patent: May 30, 2006

(54) FAN ROTOR SYSTEMS HAVING COLLAPSIBLE FAN BLADES

(75) Inventors: Ricardo Espinoza-Ibarra, Lincoln, CA (US); Glenn C. Simon, Auburn, CA (US); Christopher G. Malone, Loomis, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 260 days.

(21) Appl. No.: 10/653,377

(22) Filed: Sep. 2, 2003

(65) Prior Publication Data

US 2005/0047087 A1 Mar. 3, 2005

(51) Int. Cl.
*H05K 7/20* (2006.01)

(52) U.S. Cl. ..... 361/695; 361/694; 415/66; 416/1

(58) Field of Classification Search ..... 361/686–695, 361/704–712, 717–719; 454/184; 165/104.33, 165/104.34, 121, 127, 165, 185; 415/1, 68, 415/66, 141, 67; 416/5, 88, 142, 143, 146 R, 416/170 R, 186 R, 223 B, 132 R, 210 R, 416/87, 131; 248/519, 523, 529
See application file for complete search history.

(56) References Cited

U.S. PATENT DOCUMENTS

| | | | | |
|---|---|---|---|---|
| 2,750,104 | A | 6/1956 | Scaroulis | |
| 6,386,826 | B1 * | 5/2002 | Jacob | 415/125 |
| 6,540,479 | B1 * | 4/2003 | Liao et al. | 415/199.5 |
| 6,547,519 | B1 * | 4/2003 | deBlanc et al. | 415/141 |
| 6,699,013 | B1 * | 3/2004 | Zweighaft et al. | 416/1 |
| 6,860,713 | B1 * | 3/2005 | Hoover | 415/66 |
| 2004/0101406 | A1 | 5/2004 | Hoover | |
| 2004/0141288 | A1 * | 7/2004 | Franz et al. | 361/695 |

FOREIGN PATENT DOCUMENTS

| | | | |
|---|---|---|---|
| DE | 03739871 | C1 * | 6/1988 |
| GB | 407532 | A | 3/1934 |
| GB | 1037940 | | 8/1963 |
| GB | 1476302 | | 6/1977 |
| JP | 407158590 | A * | 6/1995 |
| JP | 409126191 | A * | 5/1997 |
| JP | 411243667 | A * | 9/1999 |

OTHER PUBLICATIONS

The Article "Ultral Reliable Fan", IBM Technical Disclosure Bulletin, Mar. 1996, USuuuuvol. # 39; Issue #3; pp. 345-346.*

* cited by examiner

*Primary Examiner*—Michael Datskovskiy

(57) ABSTRACT

A fan rotor system for cooling an electronic system includes a rotor body configured to be rotated by a fan motor and at least one collapsible fan blade mounted on the rotor body for moving cooling air through the electronic system. The at least one collapsible fan blade has a first air driving position, wherein the fan blade moves cooling air in a desired direction for cooling the electronic system, and a second air passage position, wherein the at least one collapsible fan blade is collapsed to allow cooling air to pass the at least one collapsible fan blade with less drag than when the at least one collapsible fan blade is in the first air driving position. The at least one collapsible fan blade is movable between the first air driving position when the rotor body is rotating and the second air passage position when the rotor body is not rotating.

31 Claims, 6 Drawing Sheets

FAN ROTOR SYSTEMS HAVING COLLAPSIBLE FAN BLADES

BACKGROUND

1. Field of the Invention

The present invention relates generally to the cooling of electronic systems having heat-dissipating components such as processors and, more particularly, to fan rotor systems having collapsible fan blades.

2. Related Art

Electronic systems typically include CPUs, CECs (generally, processors) and other heat-dissipating components. Such systems require a fan that pushes air through the system and/or over the components in order to keep the heat-dissipating components from overheating. Electronic systems have become more densely packaged and designing electronic systems within power and heat dissipation budgets have become more difficult. This evolution has posed a number of design challenges with respect to fan power consumption and the effect of fans on the heat dissipation characteristics of the overall system.

As an example of such densely packaged electronic systems, advances in the miniaturization of computer, communication and other electronic equipment have led to the development of so-called "blade" systems, which permit several circuit boards ("blades") to be installed in a single chassis. The chassis typically includes components, such as power supplies, cooling fans, a blade manager and other components that are shared by the blades installed in the chassis. The blades typically plug into a backplane of the chassis, which distributes power and data signals between the blades, blade manager and other components. This arrangement enables a large number of blades to be housed in a relatively small chassis. Oftentimes, the chassis dimensions enable it to be mounted in a rack, such as a server rack with other rack-mounted equipment.

Blades can perform various functions. Most blades contain entire computers, including single or multiple processors, memory, and network interfaces. Oftentimes, computer blades are used as servers while others are used as communication devices, such as routers, firewalls or switches. Some blades contain specialized hardware components, in addition to or instead of general-purpose processors, memory, etc. In general, blades include any number of heat-dissipating components.

Some server blades include disk drives. Other blades access disk drives that are located elsewhere in the chassis or are connected to the chassis by computer network hardware. Typically, any type of blade can be plugged into any slot of a chassis. This enables an operator or system manager to combine blades in a chassis so that requisite operations can be performed by the blade system. In addition, the mixture of blade types can be changed to accommodate changes in operational requirements. For example, a system operator might choose to logically connect a blade to different disk drives to execute different application programs at different times of a day. In another example, if a blade fails, logical connections from off-blade disk drives that were formerly used by the failed blade can be redirected to a replacement or hot standby blade.

As noted above, while densely packaged electronic systems such as blade systems provide many advantages, several engineering challenges arise when using them. Among these challenges is the challenge of designing and operating a bladed system such that sufficient heat is dissipated in the limited space available in the chassis that hosts the system. Some known power limiting strategies include powering down a CPU functional unit, e.g., a floating point unit or an on-die cache, or reducing speed to attain reduced power consumption in a hard drive. To address heat dissipation challenges, bladed server systems can be designed with an underlying power and thermal envelope. For example, when a chassis that hosts a bladed system has a limited amount of airflow available to cool the blades (i.e., when the system can only dissipate a limited amount of heat), then the chassis is designed for a limited amount of power consumption and an associated limited performance of the blades.

As a result of the modularity, flexibility, and requirements of bladed and other densely packaged electronic systems, however, the systems, and also different portions or zones within the systems will require multiple fans to cool the electronics. Examples of such a multiple fan arrangement include multiple redundant fans within a single fan system package, as well as push-pull fan arrangements with one or more fans provided on a cooling air intake portion of an electronic system or zone within an electronic system and one or more fans provided on a cooling air output portion, or other combinations of multiple fans provided in series along a cooling zone. While the provision of such fans can provide some level of cooling, if one or more fans in the series of cooling fans should fail for any reason (such as, mechanical or electrical failure, power failure or shutdown due to exceeding system power budget, physical obstruction of the fan rotor, etc,), the failed fan creates a drag on the cooling air flowing therethrough. This can result in increased demand on other fans, overheating of the electronics, and/or scaling back of the performance of the electronics to prevent overheating.

SUMMARY

In one aspect of the invention, a fan rotor system is provided for cooling an electronic system. The fan rotor system includes a rotor body configured to be rotated by a fan motor and at least one collapsible fan blade mounted on the rotor body for moving cooling air through the electronic system. The at least one collapsible fan blade has a first air driving position, wherein the fan blade moves cooling air in a desired direction for cooling the electronic system, and a second air passage position, wherein the at least one collapsible fan blade is collapsed to allow cooling air to pass the at least one collapsible fan blade with less drag than when the at least one collapsible fan blade is in the first air driving position. The at least one collapsible fan blade is movable between the first air driving position when the rotor body is rotating and the second air passage position when the rotor body is not rotating.

In another aspect of the invention, a fan rotor system for cooling an electronic system includes a rotor body configured to be rotated by a fan motor and at least one collapsible fan blade mounted on the rotor body for moving cooling air through the electronic system. In this aspect, the at least one collapsible fan blade has a fixed portion fixedly attached to the rotor body, and a movable portion attached by an articulating joint to the fixed portion. The at least one collapsible fan blade is movable between a first air driving position when the rotor body is rotating and a second air passage position when the rotor body is not rotating.

In a further aspect of the invention, a fan rotor system for cooling an electronic system again includes a rotor body configured to be rotated by a fan motor and at least one collapsible fan blade mounted on the rotor body for moving cooling air through the electronic system. In this aspect, however, the at least one collapsible fan blade has a fixed portion fixedly attached to and extending outwardly from the rotor body, a movable portion rotatingly attached to and extending outwardly from the rotor body, and a blade material connected to the fixed and movable portions to form a fan blade. Once again, the at least one collapsible fan blade is movable between a first air driving position when the rotor body is rotating and a second air passage position when the rotor body is not rotating.

In a still further aspect of the invention, a fan rotor system for cooling an electronic system includes a rotor body configured to be rotated by a fan motor and a plurality of collapsible fan blades mounted on the rotor body for moving cooling air through the electronic system. At least one of the collapsible fan blades is rotatable about the rotor body with respect to at least one other collapsible fan blade. The at least one collapsible fan blade is movable between a first air driving position when the rotor body is rotating and a second air passage position when the rotor body is not rotating.

In another aspect of the invention, an electrical system having heat dissipating electronics and at least two fan rotor systems configured to cool the heat dissipating electronics is provided. This aspect includes first and second rotor bodies where each rotor body configured to be rotated by a fan motor and at least one collapsible fan blade mounted on at least one of the rotor bodies for moving cooling air through the electronic system. The at least one collapsible fan blade has a first air driving position, wherein the fan blade moves cooling air in a desired direction for cooling the electronic system, and a second air passage position, wherein the at least one collapsible fan blade is collapsed to allow cooling air to pass the at least one collapsible fan blade with less drag than when the at least one collapsible fan blade is in the first air driving position. The at least one collapsible fan blade is movable between the first air driving position when the rotor body is rotating and the second air passage position when the rotor body is not rotating.

DETAILED DESCRIPTION

The present invention provides fan rotor systems having collapsible blades for cooling electronic systems as well as electronic systems themselves that are cooled by such fan rotors. In general, the fan rotor systems include a plurality of collapsible fan bladea. Each collapsible fan blade has a first air driving position wherein the fan blade moves cooling air in a desired direction for cooling the electronic system, and a second air passage position wherein the fan blade is collapsed to allow cooling air to pass the fan blade with less drag than when the fan blade is in the first air driving position. By moving from the first air driving position when the rotor body is rotating to the second air passage position when the rotor body is not rotating, the fan blade can reduce the drag it places on cooling air that is being driven by other fans when the fan having the collapsible blades fails, is turned off, or otherwise stops turning due to an obstruction or some other reason. In this way, redundant or other fans in series with a fan having a fan rotor system of the invention will not be overly hindered by such a stoppage.

Electronic systems of the invention can include a variety of systems having heat dissipating electronic components. Such systems include, for example, desktop personal computers or workstations, rack mounted servers or other rack mounted electronic devices, and blades or bladed systems. For purposes of providing an example, the present invention will be described in the context of a blade system. As noted, a blade system is a printed circuit board which is installed in a chassis along with a plurality of other printed circuit boards, or blades. One of ordinary skill in the art can, however, apply the teachings herein to other types of electronic systems, including but not limited to those listed above.

Figure 1:
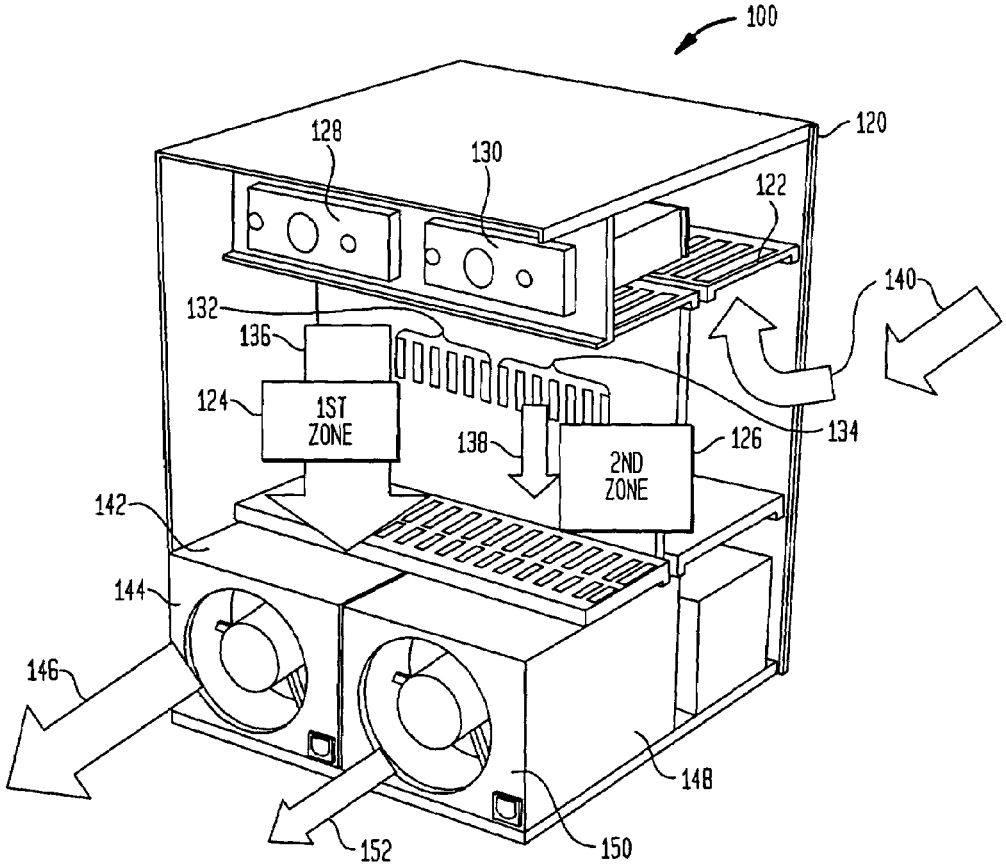
FIG. 1 is a diagrammatic illustration of an electronic system of the invention.

FIG. 1 illustrates an exemplary electronic system 100 of the invention having a chassis 120 holding at least one card cage 122 for further holding replaceable electronic modules in two zones: a first zone 124 and a second zone 126. In order to view other details of chassis 120, replaceable electronic modules or blades have not been illustrated in FIG. 1, but rather first zone 124 (the left zone), which may have one or more blades connected to first zone connectors 132, and second zone 126 (the right zone), which may have one or more blades connected to second zone connectors 134. While exemplary electronic system 100 of the invention is illustrated as having two zones of blades that can be separately cooled, the present invention does not rely on any particular number of cooling zones and the electronic system being cooled can have only one such zone or more than two zones. Similarly, and as noted above, blade system 100 is just one example of an electronic system in which the present invention can be implemented.

Exemplary electronic system 100 of FIG. 1 includes a first zone fan 128, which creates a first zone air flow 136, and a second zone fan 130, which creates a second zone air flow 138, with both fans pulling air from a cooling air input flow 140. First zone air flow 136 is illustrated as being significantly larger than second zone airflow 138, suggesting that first zone fan 128 and second fan 130 have been independently controlled to provide, or have accidentally provided, a greater air flow through first zone 124 than in second zone 126.

In the illustrated configuration, first and second power supplies 142, 148 are provided with first and second power supply fans 144, 150 which draw air from first zone 124 and second zone 126, respectively, through power supplies 142, 148 to create first and second power supply output air flows 146, 152. As illustrated, first power supply output air flow 146 is larger than second power supply output air flow 152 by an amount that is approximately proportional to the amount by which first zone air flow 136 is larger than second zone air flow 138. The illustrated electronic system 100 thus provides two cooling zones with each cooling zone having two fans in series, and in particular, with the pair of fans serving each zone being in a "push-pull" configuration.

FIGS. 2A to 2C, 3A to 3C, and 4A to 4D illustrate three embodiments of fan rotor systems of the invention having collapsible blades. The fan rotor systems can be used in any of the fans 128, 130, 144, 150 (FIG. 1) in order to provide the advantages of the invention within the context of electronic system 100 or any other electronic system that includes cooling fans, and in particular, that includes a plurality of cooling fans provided in series.

Figure 2A:
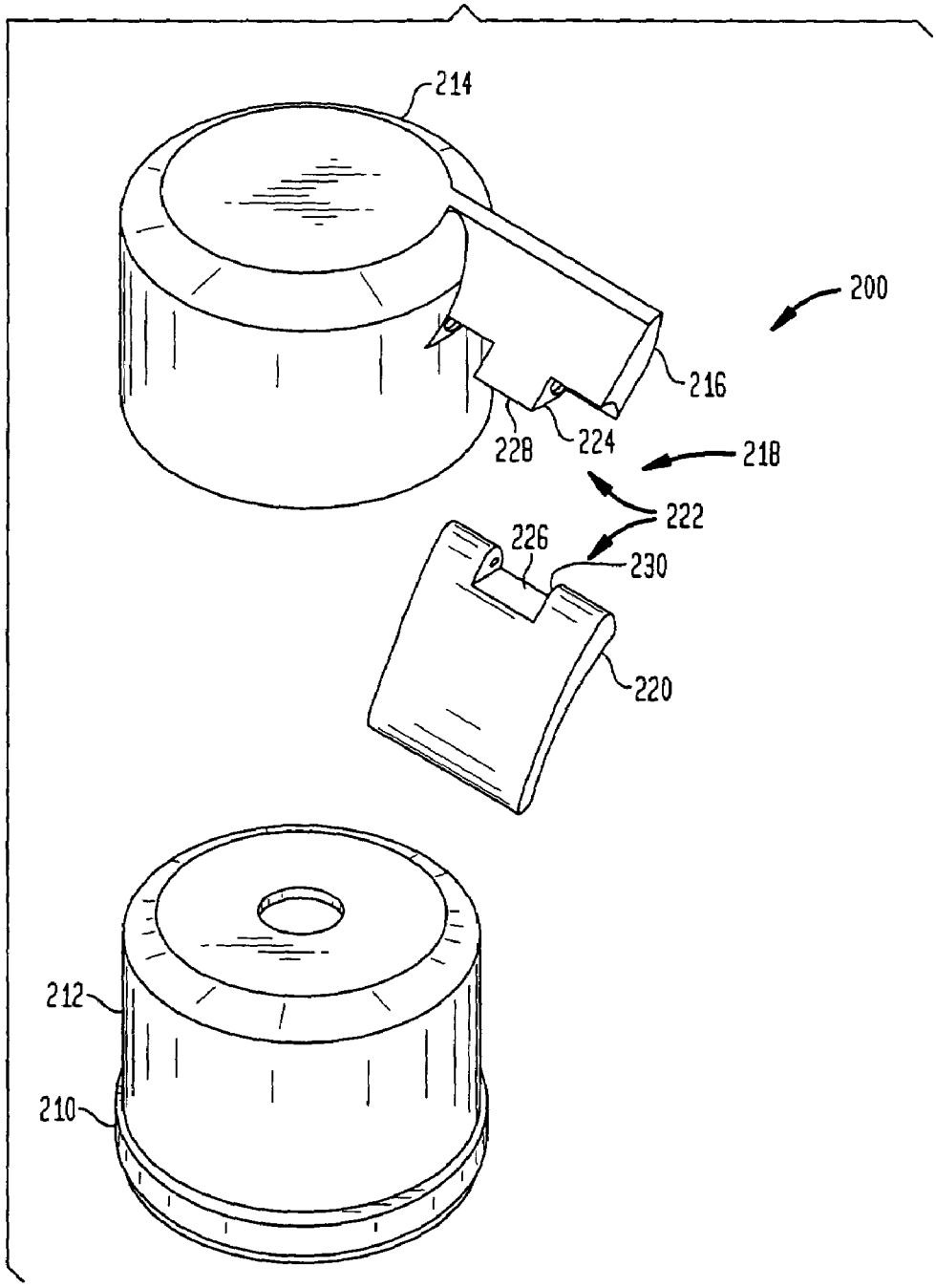
FIG. 2A is an exploded view of one embodiment of a fan rotor system of the invention useful in the system of FIG. 1 with a single blade illustrated.
Figure 2B:
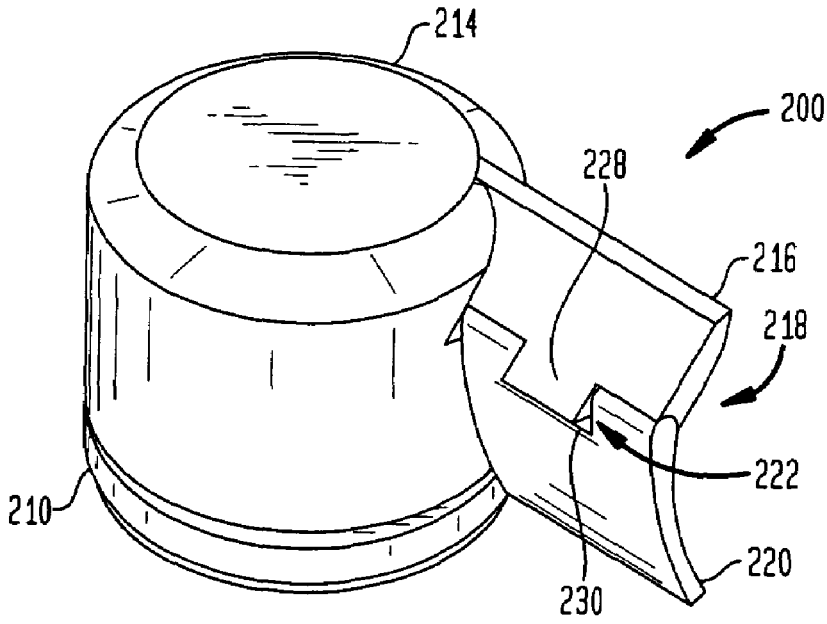
FIG. 2B is a perspective view of the embodiment of a fan rotor system of the invention shown in FIG. 2A.
Figure 2C:
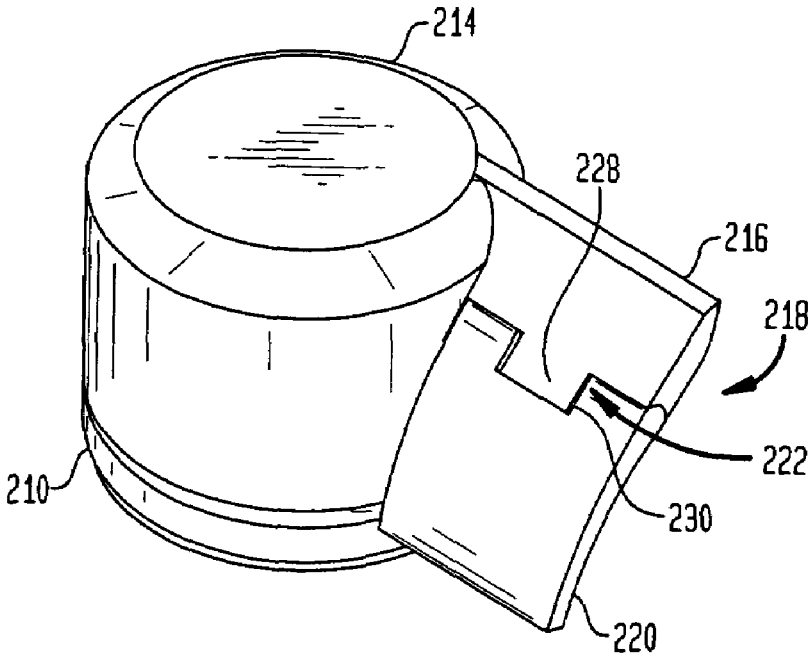
FIG. 2C is a perspective view of the embodiment of the fan rotor system shown in FIGS. 2A and 2B.

FIGS. 2A, 2B, and 2C illustrate a first embodiment of a fan rotor system 200 having at least one collapsible blade in exploded view, perspective view with the blade in an air passage position, and perspective view with the blade in an air driving position, respectively. A base 210 and cup 212 of a motor that will drive the rotor system are shown most clearly in the exploded view of FIG. 2A. A rotor 214 fits over motor cup 212 in a manner that allows the rotor 214 to be driven by the motor and includes a fixed portion 216 of blade 218 fixedly attached to the rotor. Only one blade 218 is provided in the Figures for ease of illustration, but a person skilled in the art would understand that a plurality of blades could be provided. A movable portion 220 of blade 218 is hingedly attached to fixed portion of blade 218 to allow the movable portion to move between an air passage position (illustrated in FIG. 2B) when rotor system 200 is not rotating and an air driving position (illustrated in FIG. 2C) when the rotor system is rotating. While the illustrated embodiment shows one moveable portion 220 of blade 218, it should be understood that two or more hinged movable blade portions could be employed and that articulating joints other than hinges could be used as well.

In general, blade 218 is collapsed in the air passage position so that cooling air can pass rotor system 200 with less drag than when the blade is in the air driving position. Movement of movable portion 220 into the air passage position in the illustrated embodiment can be accomplished by the application of at least two forces. First, where rotor system 200 is placed in series with another fan (as in either of first zone 124 or second zone 126 of electronic system 100 of FIG. 1), aerodynamic forces from the cooling air driven by the other fan will force movable portion 220 toward a lower drag position. In addition, in the illustrated orientation (as well as in certain other orientations which should be apparent), gravitational forces can aid in forcing movable portion 220 into the air passage position upon the stopping of rotation of rotor system 200. Thus rotor system 200 could preferably be used within fans 128, 130 in electronic system 100 of FIG. 1 in order to apply both of these forces to move movable portion 220 into the air passage position.

In general, at least two forces can be employed to move movable portion 220 into the air driving position upon the rotation of rotor system 200 as well. First, centripetal forces could be employed to force the desired movement. Second, aerodynamic forces on the now active blade 218 will also tend to force movable portion 220 into the air driving position. A stop element 222 can be employed to stop movement of movable portion 220 into the air driving position so that the movable portion will be held in a desired position for optimizing its efficiency in driving cooling air. In the illustrated embodiment, the stop element is provided by opposed stop surfaces 224, 226 provided on a tab 228 on fixed portion 216 and on a slot 230 on movable portion 220. When movable portion 220 reaches its full air driving position, stop surfaces 224, 226 abut each other to prevent further movement of movable portion in that direction, and at least centripetal and aerodynamic forces will hold movable portion 220 in that position until rotor system slows below a certain level. It will be understood that other forces could be employed to move movable element 220 between positions and that other stop elements could be used to hold the movable element in its driving position.

Figure 3A:
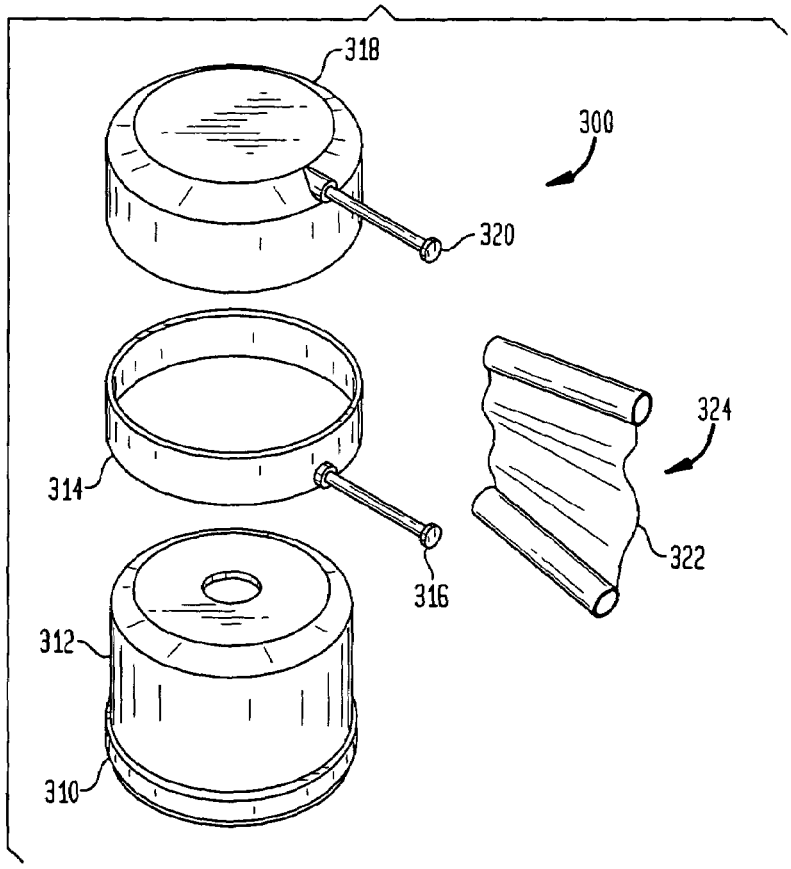
FIG. 3A is an exploded view of a further embodiment of a fan rotor system of the invention useful in the system of FIG. 1 with a single blade illustrated.
Figure 3B:
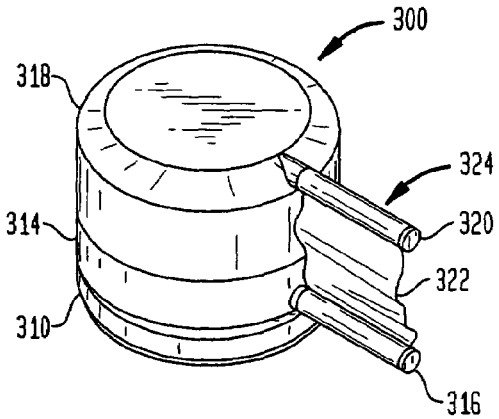
FIG. 3B is a perspective view of the embodiment of the fan rotor system of the invention shown in FIG. 3A in an air passage position.
Figure 3C:
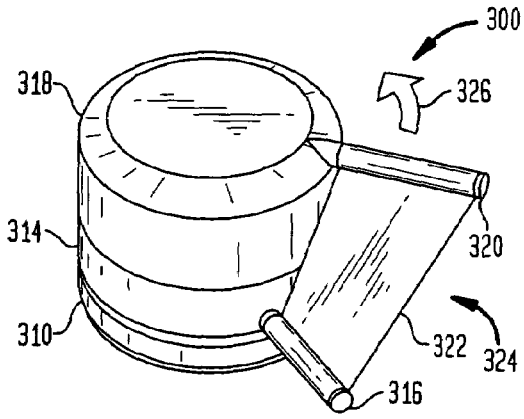
FIG. 3C is a perspective view of the embodiment of the fan rotor system of the invention shown in FIG. 3A in an air driving position.

FIGS. 3A, 3B, and 3C illustrate a second embodiment of a fan rotor system 300 having at least one collapsible blade in exploded view, perspective view with the blade in an air passage position, and perspective view with the blade in an air driving position, respectively. A base 310 and cup 312 of a motor that will drive the rotor system are shown most clearly in the exploded view of FIG. 3A. A lower rotor ring 314 having an extending sail blade holding member 316 fits over motor cup 312 and can rotate with respect to the motor cup. A top rotor ring 318 having an extending sail blade holding member 320 also fits over motor cup 312, however, top rotor ring 318 is fixed and will rotate with the motor cup. A sail blade 322 connects at opposed ends to top rotor ring extending member 320 and lower rotor ring extending member 316 to form a collapsible blade 324.

Collapsible blade 324 can move between an air passage position (illustrated in FIG. 3B) when rotor system 300 is not rotating and an air driving position (illustrated in FIG. 3C) when the rotor system is rotating in the direction of arrow 326. While the illustrated embodiment shows one collapsible blade 324, it should be understood that two or more collapsible blades could be employed as well. Such a multi-blade construction could be prepared by including a plurality of extending members on top rotor ring 318, with a corresponding number of extending members on lower rotor ring 314 and a corresponding number of sail blades arranged between the extending members—in this way, movement of a plurality of collapsible blades between the air passage and air driving positions would be coordinated.

In the illustrated embodiment, collapsible blade 324 will move between the air passage and air driving positions largely due to aerodynamic forces as described above for the embodiment of FIGS. 2A, 2B and 2C. Collapsible blade 324 can also be designed to use centripetal force to move into the air driving position and can use characteristics of sail blade 322 material to urge the blade toward the air passage position as well. For example, while sail blade 322 material could be, in general, any type of fabric or flexible plastic, the sail blade could be formed of or include a low spring constant elastic that would tend to pull lower rotor ring extending member 316, and thus collapsible blade 324, toward the air passage position. In addition, lower rotor ring 314 could be spring biased with respect to either motor cup 312 or top rotor ring 318.

While a separate stop element for holding collapsible blade 324 in the air driving position is not illustrated, it should be clear that sail blade 322 itself serves to stop the movement of the blade in the air driving position when the sail blade becomes fully stretched. If desired, other stop elements could be added, for example by employing the tabs and slots illustrated with the embodiment below.

In one alternative embodiment, an optimal blade profile is molded into lower rotor ring 314 and top rotor ring 318. As the fan spins, the sail material 322 would contact with the blade profile, causing the material to take its shape. Having such an aerodynamically tuned profile may increase the performance of rotor system 300.

Because rotor system 300 does not depend upon gravitational forces as rotor system 200 does in part, rotor system 300 can be placed in virtually any orientation and could be used, for example, in electronic system 100 as any or all of first and second zone fans 128, 130 or first and second power supply fans 144, 150.

FIGS. 4A, 4B, 4C and 4D illustrate a third embodiment of a fan rotor system 400 having at least one collapsible blade in exploded view, first perspective view with the at least one blade in an air passage position, second perspective view with the at least one blade in an air passage position, and perspective view with the at least one blade in an air driving position, respectively. Unlike the previous embodiments, the embodiment illustrated here does not involve a blade that collapses individually. Rather, in this embodiment, the "at least one collapsible blade" refers to a blade that "collapses" to a second blade in the air passage position so that the two blades together in this collapsed position provide a lower drag on cooling air flow than when the blades are in a spaced apart position for air driving. In the following description, a rotor system 400 having three collapsible blades is illustrated (in the collapsed air passage position in FIGS. 4B and 4C, and in the air driving position in FIG. 4D), however, it should be apparent that more or fewer blades could make up the at least one collapsible blade.

Figure 4A:
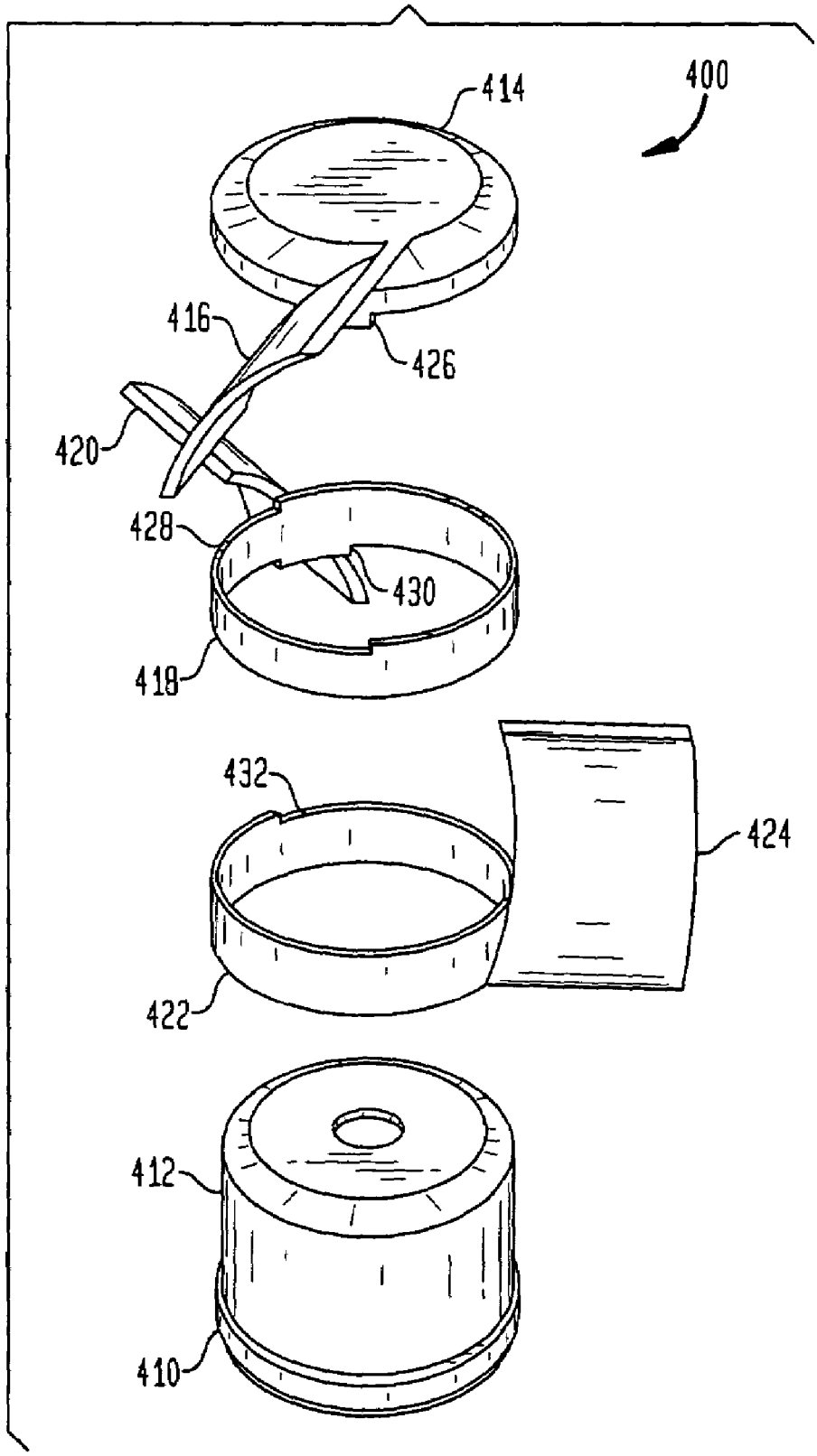
FIG. 4A is an exploded view of a still further embodiment of a fan rotor system of the invention useful in the system of FIG. 1 with a single blade illustrated.

In fan rotor system 400, base 410 and cup 412 of a motor that will drive the rotor system are shown most clearly in the exploded view of FIG. 4A. A lower rotor ring 422 having a blade 424 extending outward from the ring fits over motor cup 412 and can rotate with respect to the motor cup. A middle rotor ring 418 having a blade 420 extending outward from the ring also fits over motor cup 412 and can rotate with respect to the motor cup and with respect to lower ring 422. An upper rotor ring 414 having a blade extending outward therefrom also fits over motor cup 412, however, top rotor ring 412 is fixed and will rotate with the motor cup (though the other rings can rotate with respect to it).

Figure 4B:
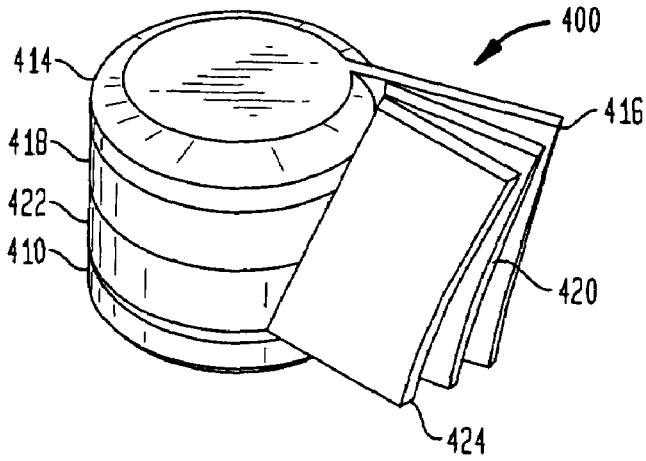
FIG. 4B is a perspective view of the fan rotor system shown in FIG. 4A in an air passage position.
Figure 4C:
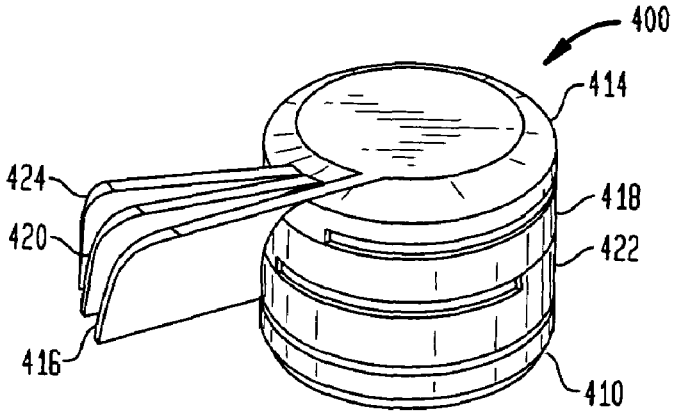
FIG. 4C is a different perspective view of the fan rotor system shown in FIG. 4A in an air passage position.
Figure 4D:
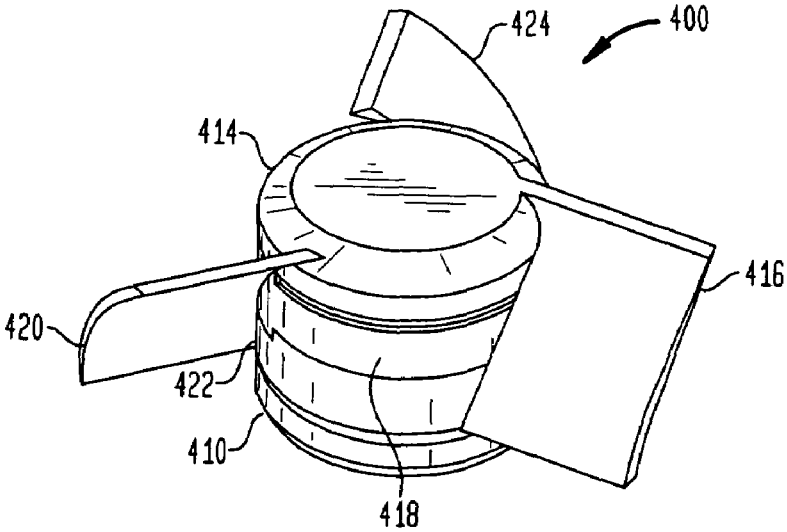
FIG. 4D is a different perspective view of the fan rotor system shown in FIG. 4A in an air driving position.

Stop elements can be provided on the blades and/or rings in order to fix the blades in preferred positions, especially in the air driving position. For example, in the illustrated embodiment (best shown in FIG. 4A), upper rotor ring 414 can be provided with a tab 426 facing middle rotor ring 418 and cooperating with slot 428 on the middle ring to provide stops against relative motion between the two rings. Similarly, middle rotor ring can be provided with a tab 430 facing lower rotor ring 422 and cooperating with slot 432 on the lower ring to provide stops against relative motion between the two rings. In the illustrated embodiment, these stop elements are configured to allow the blades to move close together and overlap (thereby reducing drag on passing cooling air; FIGS. 4B and 4C) and to stop the movement of the blades toward the air driving position (FIG. 4D) when the three blades are equally spaced around rotor system 400.

As illustrated, aerodynamic forces (as described above with respect to the other illustrated embodiments) can move the at least one collapsible blade between the air passage and air driving positions. As one of ordinary skill in the art would find apparent, however, additional or alternative forces such as centripetal, spring bias and other forces can be employed to drive the fan blades into a minimum air resistance position in the event of a fan failure.

Embodiments have been described in which the present invention is employed in a bladed electronic system to provide cooling fans having at least one collapsible fan blade that can move to an air passage position upon the stopping of the fan to reduce drag on cooling air through the system. However, one of ordinary skill in the art can apply the teachings herein to systems having other types of electronic systems and fans. For example, rack mounted servers or other rack mounted electronic components can have multiple heat-dissipating components and include multiple fans to cool such servers. In fact, the fan rotor systems of the invention and fans that use them can be used in any system, and preferably in systems in which cooling fans are operated in series. Such systems could readily be adapted to utilize the present invention.

The terms and expressions employed herein are used as terms of description, not of limitation. There is no intention, in using these terms and expressions, to exclude any equivalents of the features shown or described or portions thereof. Practitioners in the art will recognize that other modifications are possible within the scope of the invention claimed.

The invention claimed is:

1. A fan rotor system for cooling an electronic system, comprising:

a rotor body configured to be rotated by a fan motor; and at least one collapsible fan blade mounted on the rotor body for moving cooling air through the electronic system, the at least one collapsible fan blade having a fixed portion fixedly attached to the rotor body, and a plurality of movable portions, each attached by an articulating joint to the fixed portion;

wherein the at least one collapsible fan blade is movable between a first air driving position when the rotor body is rotating and a second air passage position when the rotor body is not rotating.

2. The fan rotor system of claim 1, wherein aerodynamic forces on the at least one collapsible fan blade force movement between the air driving and air passage position.

3. The fan rotor system of claim 2, wherein gravitational forces also force the at least one collapsible fan blade toward the air passage position.

4. The fan rotor system of claim 1, wherein at least one of the articulating joints is a hinge.

5. The fan rotor system of claim 1, wherein at least one stop element is provided on each collapsible fan blade.

6. The fan rotor system of claim 5, wherein the at least one stop element on each collapsible fan blade operates to limit movement of the fan blade in a direction toward the air driving position.

7. The fan rotor system of claim 1, wherein a plurality of collapsible fan blades are attached to the rotor body.

8. The fan rotor system of claim 1, wherein the fan rotor system is provided in series with a second fan rotor system.

9. The fan rotor system of claim 8, wherein the second fan rotor system includes at least one collapsible fan blade.

10. The fan rotor system of claim 8, wherein the fan rotor system is provided within an electronic system.

11. A fan rotor system for cooling an electronic system, comprising:

a rotor body configured to be rotated by a fan motor; and at least one collapsible fan blade mounted on the rotor body for moving cooling air through the electronic system, the at least one collapsible fan blade having a fixed portion fixedly attached to and extending outwardly from the rotor body, a movable portion rotatingly attached to and extending outwardly from the rotor body, and a blade material connected to the fixed and movable portions to form a fan blade;

wherein the at least one collapsible fan blade is movable between a first air driving position when the rotor body is rotating and a second air passage position when the rotor body is not rotating.

12. The fan rotor system of claim 11, wherein aerodynamic forces on the at least one collapsible fan blade force movement between the air driving and air passage position.

13. The fan rotor system of claim 12, wherein centripetal or centrifugal forces also force the at least one collapsible fan blade toward the air passage position.

14. The fan rotor system of claim 11, wherein at least one stop element is provided on each collapsible fan blade.

15. The fan rotor system of claim 14, wherein the at least one stop element on each collapsible fan blade operates to limit movement of the fan blade in a direction toward the air driving position.

16. The fan rotor system of claim 11, wherein a plurality of collapsible fan blades are attached to the rotor body.

17. The fan rotor system of claim 16, wherein the fixed portion includes a plurality of extending members for connecting a first end of the blade material for each collapsible fan blade and the movable portion includes a plurality of extending members for connecting a second end of the blade material for each collapsible fan blade wherein each of the collapsible blades moves between positions in unison as the movable portion rotates.

18. The fan rotor system of claim 11, wherein the fan rotor system is provided in series with a second fan rotor system.

19. The fan rotor system of claim 18, wherein the second fan rotor system includes at least one collapsible fan blade.

20. The fan rotor system of claim 18, wherein the fan rotor system is provided within an electronic system.

21. A fan rotor system for cooling an electronic system, comprising:

a rotor body configured to be rotated by a fan motor; and a plurality of collapsible fan blades mounted on the rotor body for moving cooling air through the electronic system wherein at least one of the collapsible fan blade is rotatable about the rotor body with respect to at least one other collapsible fan blade;

wherein the plurality of collapsible fan blades is movable between a first air driving position when the rotor body is rotating and a second air passage position when the rotor body is not rotating.

22. The fan rotor system of claim 21, wherein aerodynamic forces on the at least one collapsible fan blade force movement between the air driving and air passage position.

23. The fan rotor system of claim 22, wherein centripetal or centrifugal forces also force the at least one collapsible fan blade toward the air passage position.

24. The fan rotor system of claim 21, wherein the plurality of collapsible fan blades moves to the air passage position by rotating at least one collapsible fan blade about the rotor body so as to overlap with another collapsible fan blade.

25. The fan rotor system of claim 24, further comprising a fan blade to which at least one rotatable collapsible fan blade moves to overlap in the air passage position.

26. The fan rotor system of claim 21, wherein at least one stop element is provided on each collapsible fan blade.

27. The fan rotor system of claim 26, wherein the at least one stop element on each collapsible fan blade operates to limit movement of the fan blade in a direction toward the air driving position.

28. The fan rotor system of claim 21, wherein a plurality of collapsible fan blades are attached to the rotor body.

29. The fan rotor system of claim 21, wherein the fan rotor system is provided in series with a second fan rotor system.

30. The fan rotor system of claim 29, wherein the second fan rotor system includes at least one collapsible fan blade.

31. The fan rotor system of claim 29, wherein the fan rotor system is provided within an electronic system.

* * * * *